US005588415A

United States Patent [19]

Ahern

[11] Patent Number: 5,588,415

[45] Date of Patent: Dec. 31, 1996

[54] ENGINE MANAGEMENT SYSTEM

[75] Inventor: Steven R. Ahern, Claremont, Australia

[73] Assignee: Orbital Engine Company Pty. Limited, Balcatta, Australia

[21] Appl. No.: 475,346

[22] Filed: Jun. 7, 1995

Related U.S. Application Data

[62] Division of Ser. No. 87,712, Jul. 14, 1993, Pat. No. 5,427,083.

[30] Foreign Application Priority Data

Jan. 14, 1991 [AU] Australia ..... PK4177

[51] Int. Cl.[6] ..... F02M 51/00

[52] U.S. Cl. ..... 123/676

[58] Field of Search ..... 123/676, 489, 123/571, 674, 679

[56] References Cited

U.S. PATENT DOCUMENTS

| | | | |
|---|---|---|---|
| 4,408,585 | 10/1983 | Stuckas | 123/676 |
| 5,103,791 | 4/1992 | Tomisawa | 123/489 |
| 5,239,971 | 8/1993 | Uchinami | 123/571 |
| 5,349,936 | 9/1994 | Uchinami | 123/676 |
| 5,427,083 | 6/1995 | Ahern | 123/676 |

*Primary Examiner*—Raymond A. Nelli

*Attorney, Agent, or Firm*—Nikaido Marmelstein Murray & Oram LLP

[57] ABSTRACT

A method for controlling fuel supplied to an engine includes steps of conducting tests on a representative model of a family of engines to obtain constants and coefficients of operating characteristics of the representative engine under ambient and induced temperatures and pressures, and creating look-up maps from which such coefficients may be obtained to compute actual operating conditions. When an engine is used in performance of normal operations, sensors are provided to determine actual operating temperatures and pressures which are used to select appropriate constants and coefficients for calculating engine fuel requirements in accordance with an algorithm, and using the calculated result to control flow to fuel to the engine under normal operating conditions.

6 Claims, 1 Drawing Sheet

ENGINE MANAGEMENT SYSTEM

Figure 1:
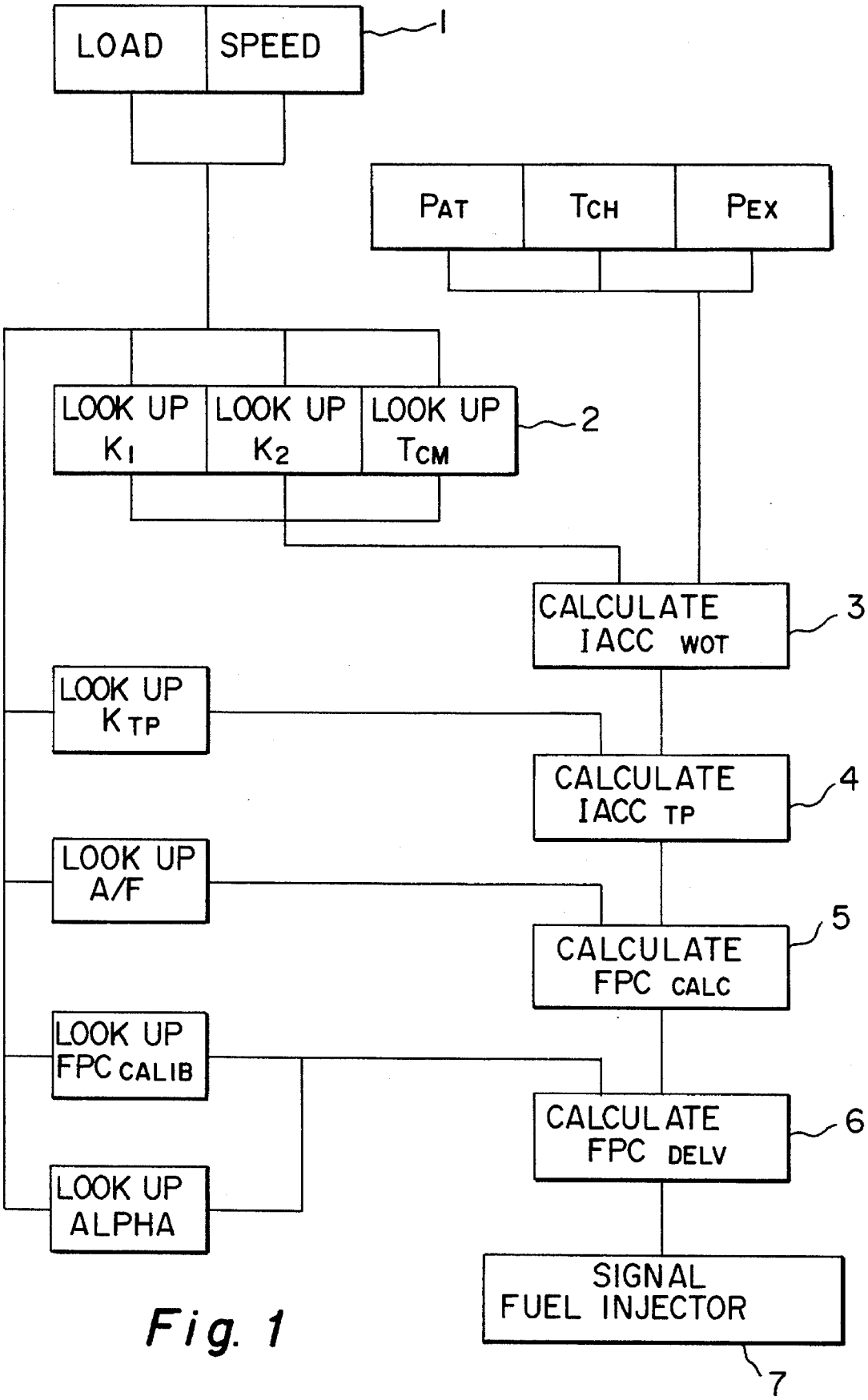

This is a division of application Ser. No. 08/087,712 filed Jul. 14, 1993 now U.S. Pat. No. 5,427,083.

This invention relates to a method of determining the mass of air induced per cycle to an internal combustion engine for the purposes of controlling the air/fuel ratio as pan of the engine management system.

It is known to use various types of mass air flow sensors in the air induction system of an engine to determine the mass rate of air induced into the engine over the full range of operating conditions of the engine. Other means for determining the air flow have also been used, such as providing a calibration in the memory of an ECU of air flow in relation to engine speed and throttle position.

Although these known techniques for determining the mass of induced air are effective, they have disadvantages either from the point of view of the nature of the equipment required, including the cost and effective life thereof, and/or the quantity of memory capacity required to store relevant information.

It is therefore the object of the present invention to provide a method of determining the mass of air introduced to an internal combustion engine under operating conditions which is effective, and requires less hardware and/or memory storage capacity to provide an effective control of the air/fuel ratio of the engine under all operating conditions.

With this object in view, there is provided according to the present invention a method of determining the mass of air introduced per cylinder per cycle (IACC) of an internal combustion engine comprising the steps of:

calculating the IACC at wide open throttle ($IACC_{WOT}$) for the existing engine speed and operating conditions, selecting from predetermined coefficients indicating the relationship between $IACC_{WOT}$ and IACC at preselected pan-load the coefficient relating to the current load and speed; and applying said selected coefficient to said $IACC_{WOT}$ to determine the current IACC ($IACC_{LD}$).

More specifically, there is provided a method of determining the mass of air introduced per cylinder per cycle (IACC) of an internal combustion engine comprising:

programming a processor with an algorithm to determine the IACC for the engine at wide open throttle (WOT) ($IACC_{WOT}$) over a selected engine speed operating range, storing in memory coefficients relating the $IACC_{WOT}$ to the IACC at selected load demands below WOT over said selected engine speed range, sensing while the engine is operating the engine speed and load demand and selecting the respective coefficients for the sensed engine speed and load demand, inputting to the programmed algorithm the IACC coefficient relating to the sensed engine load demand at the sensed engine speed determining from said inputs the IACC for the existing engine operating conditions ($IACC_{CALC}$), and determining from said $IAACC_{CALC}$ and sensed engine speed and bad demand the required mass of fuel per cylinder per cycle (FPC).

On the basis of this determined FPC, a signal is issued to a fuel metering means to activate same to deliver to the engine said FPC amount of fuel in timed relation to the engine cycle.

Conveniently the processor is programmed so the algorithm adjusts the $IACC_{WOT}$ in response to variations in selected engine operating conditions such as intake air temperature or pressure, or exhaust pressure. The selected engine operating conditions may be related to respective datum values, the datum values preferably are the values of the respective engine operating condition existing at calibration of the IACC coefficients stored in the memory.

The processor may be programmed so that if one or more of the engine operating conditions is sensed to be fluctuating regularly within a relatively short time interval, the effects of the fluctuations on the air mass calculation will be limited. The limiting of the effect of the fluctuations is preferably carried out within a select range of load demand and/or engine speed, preferably in the lower range. Alternatively, if it is known that the intended use of the engine can give rise to such fluctuation at certain operating conditions, then the processor program can be adapted to limit the effect of such fluctuation whenever it is operating at those certain operating conditions, irrespective of whether such fluctuation is or is not occurring. By way of example a marine engine operating at low speed such as while trolling may pass through a series of waves which will cause a near cyclic variation in exhaust pressure. This in turn may cause the engine to "hunt" for a stable operating condition. By reducing the effect of exhaust pressure the "hunting" can be reduced or eliminated.

In a preferred form, the method of determining the mass of induced air per cylinder per cycle (IACC) of a particular engine comprise:

programming a processor with an algorithm to determine the IACC for the engine speed operating range dependent upon atmospheric pressure ($P_{AT}$) exhaust pressure ($P_{EX}$), and manifold charge temperature ($T_{CH}$), storing in memory respective coefficients relating to $P_{AT}$, $P_{Ex}$ and $T_{CH}$ for selected engine speeds within the operating speed range, storing in memory coefficients relating the $IACC_{WOT}$ to the IACC at selected load demands below WOT at each said selected speed, sensing while the engine is operating the $P_{AT}$, $P_{EX}$, $T_{CH}$, engine speed and load demand and selecting the respective coefficients for each at the sensed load demand and engine speed, inputting to the programmed algorithm respective signals indicating the existing $P_{AT}$, $P_{EX}$ and $T_{CH}$, inputting to the programmed algorithm the IACC coefficient relating to the sensed engined load demand at the sensed engine speed, determining from said inputs the IACC for the existing engine operating conditions ($IACC_{LD}$), determining from said $IACC_{LD}$ and sensed engine speed and load demand the required mass of fuel per cylinder per cycle (FPC).

It will be appreciated that the method of determining IACC as hereinbefore discussed requires no specific equipment to measure the IACC as this is determined by the inputs from simple temperature, pressure, speed and load demand sensors to an ECU suitably programmed and with the relevant coefficients stored in memory.

The present method of determining the mass of induced air is based on the discovery that the air flow at a selected position of the throttle remains a substantially constant ratio to the air flow at wide open throttle for any given engine speed, and is basically independent of ambient conditions, provided the same ambient conditions exist at both the selected and the wide open throttle positions.

Accordingly, if the air flow at wide open throttle is known for a particular engine speed at specific temperature and pressure operating conditions, then the air flow for any throttle position at that speed can be readily determined. This is achieved by programming the ECU to determine the air flow at wide open throttle and a particular engine speed under the specific operating conditions, and by applying the appropriate coefficients, calculating the air flow at the same speed for a range of load conditions covering those normally encountered by the engine in normal operation.

A suitable algorithm for calculating the IACC at wide open throttle (WOT) is:

$$iACC_{WOT}\frac{K1 \times Dcm \times P_{AT}\left[1 - K2\frac{(P_{EX})}{(P_{AT})}\right]}{T_{CM} + T_{CH}}$$

$IACC_{WOT}$: induced mass air per cylinder per cycle at wide open throttle $K_1$: cylinder displacement constant $D_{am}$: calibration coefficient $P_{AT}$: atmospheric pressure (kPa)

$P_{EX}$: exhaust pressure (steady state) (kPa)

$K_2$: exhaust pressure coefficient $T_{CM}$: temperature coefficient (degrees C)

$T_{CH}$: charge temperature (degrees C)

Thus, if the $IACC_{WOT}$ is calculated for a specific engine speed, atmospheric pressure, charge temperature, and exhaust pressure, using the above algorithm, the ECU can determine the IACC for all load demand as may be sensed, such as by the throttle position, at that selected engine speed, for which coefficients have been determined and stored in memory.

The actual IACC at any selected speed is determined by:

$IACC_{LD}=IACC_{WOT}\times K_{LD}$ $IACC_{LD}$=induced mass air per cylinder per cycle at selected load demand $K_{LD}$=selected load demand coefficient.

It is thus seen that by updating the base $IACC_{WOT}$ values for the existing speed and atmospheric and engine conditions, the IACC for any combination of operating speeds and loads (throttle positions) can be calculated.

The algorithm may include provision to allow for trapping efficiency by reference to a trapping efficiency map provided in the ECU so that calculations can be on the basis of the actual mass of air trapped in the engine cylinder per cycle. This may be particularly desirable with respect to a two stroke cycle engine. Also as an alternative to the providing of a map, the algorithm may be modified to actually directly calculated trapped mass of air per cylinder per cycle.

Using the above discussed speed and load demand as look-up parameters there is determined the required fuel mass per cylinder per cycle based on the calculated air rate for the particular existing operating conditions, referred to as $FPC_{CALC}$, for the existing $P_{AT}$, $P_{EX}$ and $T_{CH}$. This $FPC_{CALC}$ is determined as for a homogeneous charge as is desirable under WOT and other high fuelling rates. However, under stratified charge conditions, it may be advantageous to disassociate that fuelling level from the calculated air flow.

It is proposed that a weighting map, again utilising speed and throttle position as look-ups, be used such that the actual fuel delivered ($FPC_{DELV}$) is at a level between $FPC_{CALIB}$ and $FPC_{CALC}$, $FPC_{CALIB}$ being the calibrated FPC based directly on engine load and speed alone.

i.e.: $FPC_{DELV}=FPC_{CALIB}+Alpha^*\ (FPC_{CALC}-FPC_{CALIB})$

By defining the alpha (weighting) term between zero and one, the calibration can be selected to provide the desired control path, or percentage of each control path. By way of example, it may be elected to maintain $FPC_{DELV}=FPC_{CALIB}$ until homogeneous conditions were present and to then ramp the alpha term up to 1 as a function of throttle position. Under WOT conditions, the alpha value is always 1 to encompass the full correction for a change in the ambient conditions.

Under the stratified charge conditions, such as at low loads, provided that the required airflow is not set sufficiently close to the rich misfire limit airflow, that is, enough allowance for changes in the ambient conditions is made, it is possible to utilise only $FPC_{CALIB}$. An advantage of this is that the resulting fuelling level can be extremely stable without usage of system filtering that detracts from the transient performance.

The determination of the various constants and coefficients is achieved by a calibration process and will be individual to each particular engine family configuration. The principal characteristics of the engine configuration that will influence the constants and coefficients are the engine induction system and exhaust system, together with the inlet and exhaust porting. To determine these constants and coefficients, the engine is run on a particular day with known ambient conditions and then induced variations in those conditions are created to determine the effect of these variations on the air flow.

Initially the engine is run with wide open throttle at the prevailing ambient conditions and the actual air per cylinder per cycle is measured at a number of selected speeds within the normal range of operation of the engine. Further sets of measurements are made of the induced air per cylinder per cycle with introduced variations in the ambient pressure, exhaust pressure and charge temperature at the same selected speeds within the normal operating speed range. On the basis of this information the coefficients can be determined relating to the individual influence of atmospheric pressure, exhaust pressure and charge temperature. Thereafter the above measurements are repeated for a range of partial open throttle positions and from these results the coefficient determining the relationship between airflow at wide open throttle and airflow at the respective partial throttle open positions are determined.

The coefficients determined as above indicated, can then apply to all engines of the same construction as that of the engine used for calibration and thus appropriate maps can be produced for storage in the memory of the ECU to be used in controlling the fuel injection system and the management of such engines.

As previously referred to the stated preferred algorithm enables calculation of the air flow through an engine at wide-open throttle and provides the basis of a simple method to determine the air flow through an engine without the need for a dedicated air flow sensor. This is possible by the important discovery that for the same operating conditions of $P_{EX}$, $P_{AT}$ and $T_{CH}$ the ratio of the air flow at any particular throttle position is a constant proportion of the air flow at WOT for any given speed.

It is important to appreciate that the $P_{AT}$, $T_{CH}$ and $P_{EX}$ conditions must be the same for both part-load and WOT conditions.

Intuitively $P_{AT}$ and $T_{CH}$ will remain approximately steady at normal part-load operation and at WOT. However, as the load is increased from part-load to WOT, $P_{EX}$ will increase. This is particularly so with two stroke cycle engines and thus to keep $P_{EX}$ constant is an artificial state which would not be expected in practice.

Thus, by running the engine at varying loads and speeds with the same $P_{AT}$ and $T_{CH}$ a map of $K_{LD}$ can be established that takes account of the changes that arise directly from the influence of load and speed on exhaust pressure $P_{EX}$. The appropriate look-up map can then be incorporated into the ECU memory so that $IACC_{LD}$ is determined by $IACC_{LD}=IACC_{WOT}\times K_{LD}$.

The temperature constant $T_{CM}$ of the preferred algorithm is also variable with speed and load and by derivation from the algorithm it is shown $$T_{CM}=\left[\frac{(T_{CH2}-T_{CH1})\,IACC_1}{IACC1-IACC2}\right]-T_{CH1}$$

Thus by conducting two tests (1) at ambient conditions (2) at elevated $T_{CH}$ whilst keeping all other conditions equal and repeating these tests at a series of speed and load combinations an appropriate look-up maps can be developed and incorporated into the ECU memory so that $T_{CM}$ may be looked up for any combination of engine load and speed.

To determine the constants $K_1$ and $K_2$, it is known that at WOT conditions $K_{LD}=1$ and thus it can be derived from the preferred algorithm that $$K_2=\frac{P_{AT1}-AP_{AT2}}{P_{EX1}-AP_{EX2}}$$

where $$A=\frac{IACC_1\times(T_{CH1}+T_{CM})}{IACC_2\times(T_{CH2}+T_{CM})}$$

and $$K1=\frac{IAPC,\,(T_{CH1}-T_{CM})}{D_{CM}\,(P_{AT1}-K_2\,P_{EX1})}$$

By conducting two tests on the engine, both at WOT and over a range of selected engine speed:

(1) at ambient conditions (2) at induced exhaust back pressure and repeating these tests at a series of engine speeds, and taking $T_{CM}$ at WOT from the previously referred to maps, an appropriate look-up map for $K_1$ and $K_2$ and WOT can be developed.

It is necessary to also obtain $K_1$ and $K_2$ at pan-load operation as the sensitivity of the engine to exhaust pressure varies with load (throttle position). Accordingly, the two tests, previously referred to in relation to $K_1$ and $K_2$ at WOT, are repeated for each speed and load point.

Using the data from these tests, and the previously developed data regarding $T_{CM}$ and $K_{LD}$, $K_1$ and $K_2$ at part-load and over the normal speed range is determined by the following formula:

$$K_2=\frac{P_{AT1}-AP_{AT2}}{P_{EX1}-AP_{EX2}}$$

$$A=\frac{IACC_1\times(T_{CM}+T_{CH1})}{IACC_2\times(T_{CM}+T_{CH2})}$$

and $$K_1=\frac{IACC_1,\,(T_{CM}+T_{CH1})}{K_{LD}\,D_{CM}\,(P_{AT1}-K_2\,P_{EX1})}$$

By combining the $K_1$ and $K_2$ data for both WOT and throughout the load and speed operating ranges respect look-up maps for $K_1$ and $K_2$ can be developed and incorporated into the memory of the ECU so that in operation the relevant coefficients can be used in the algorithm for the prevailing engine operating conditions in the determination of $IACC_{WOT}$.

DCM is a constant related to geometry and other physical characteristics of the engine. This constant is determined experimentally and is specifically related to the engine cylinder volume at top dead centre.

The accompanying drawing depicts a logic diagram of one practical manner of operation of the method of the present invention.

The logic diagram as depicted relates to the use of the preferred algorithm as previously identified and to the use of the various maps and equations previously discussed. The procedure as represented in the logic diagram is carried out on a periodic basis whilst the engine is operating. The frequency of readings may be related to the cycle period of the engine, however, it is preferably time-based independent of engine speed.

Step 1 is to read the signal from sensors indicating respectively the engine load, engine speed, ambient temperature, ambient pressure and exhaust pressure.

Step 2 is to look up on the respective maps the values of $K_1$, $K_2$ and $T_{CM}$ for the sensed engine load and speed and feed the look up values to the algorithm. Also inputs relating to the sensed $P_{AT}$, $T_{CH}$ and $P_{EX}$ are fed to the algorithm.

Step 3 is to calculate $IACC_{WOT}$ based on the inputs of Step 2 to the algorithm.

Step 4 is to look up the $K_{LD}$ value for the sensed engine load and speed and to calculate $IACC_{TP}$ from the $K_{LD}$ value and the $IACC_{WOT}$. At this stage, the calculation of the currently existing air flow to the engine has been determined and that may be used in a number of different ways to subsequently determine the required fuel per cycle of the engine to achieve the required air fuel ratio in the engine combustion chamber.

One convenient way of proceeding to determine the FPC required by the engine is:

Step 5: look up on an appropriate air fuel ratio map the required air fuel ratio for the existing load and speed of the engine and apply this to the calculated $IACC_{TP}$ to calculated $FPC_{CALC}$.

As previously discussed in the specification, for a stratified charge engine, at low loads and hence high air fuel ratios, there is an oversupply of air available to ensure combustion of all of the fuel and thus a fuelling rate in accordance with $FPC_{CALC}$ is acceptable and desirable. However, in conditions where the air fuel mixture is substantially homogeneous, such as at WOT, it is desirable to change the fuelling rate $APC_{CALIB}$ such as in accordance with the formula previously referred to, namely, $FPC_{DELV}=FPC_{CALIB}+\text{Alpha}\,(FPC_{CALC}-FPC_{CALIB})$.

For the purpose of effecting this adjustment to the FPC respective look up maps for $FPC_{CALIB}$ and Alpha each related to engine load and speed are looked up at Step 6 to effect a variation to $FPC_{CALC}$ based on the above referred to formula to provide $FPC_{DELV}$.

On the basis of the newly calculated $FPC_{DELV}$, at Step 7 the appropriate signal is given to the fuel injector to effect delivery for the required amount of fuel to the respective cylinders of the engine.

In carrying out the invention conventional sensors as commonly used in engine management systems provide inputs to the ECU in respect of atmospheric pressure and temperature, exhaust pressure and engine load demand, the latter conveniently being a throttle position indicator. Components for these purposes are well known and are readily available, accordingly no specific description thereof is provided.

I claim:

1. A method for controlling fuel supplied to an internal combustion engine based upon determination of induced air mass per cylinder per cycle therethrough (IACC) without need for an air flow sensor, comprising the steps of:

determining engine operating characteristics from tests conducted on a representative sample of a family of engines at ambient conditions and at selective elevated charge air temperatures ($T_{CH}$) while keeping all other conditions equal, repeating these tests at a series of engine speed and load combinations, taking measurements of charge temperature ($T_{CH}$), and developing therefrom look-up maps so that $T_{CH}$ and a selected load demand coefficient $K_{LD}$ can be looked up for any combination of engine speed and load;

conducting further tests on said representative sample engine and taking measurements of at both wide open throttle (WOT) and over a range of engine speeds at ambient conditions and at induced exhaust back pressures respectively and, using these measurements and the previously developed look-up maps of $T_{CM}$ and $K_{LD}$, developing look-up maps of cylinder displacement constant ($K_1$) and exhaust pressure coefficient ($K_2$) over said speed range;

inputting signals to a memory of ECU lookup maps of respective coefficients relating to $P_{AT}$, $P_{EX}$ and $T_{CH}$ for selected engine speeds within said range of engine speeds corresponding to an operating speed range of an operational engine;

inputting signals to memory of the ECU look up maps of coefficients relating $IACC_{WOT}$ to IACC at selected load demands below WOT at each said selected speed;

providing input signals to the ECU of $T_{CH}$, $P_{AT}$ and $P_{EX}$ from said sensors while operating engines of said family:

calculating $IACC_{WOT}$ from said input signals and said look up maps provided said ECU;

calculating based upon $IACC_{WOT}$, a value for fuel per cylinder per cycle to be delivered to the engine ($FPC_{DELV}$);

providing a signal from said ECU to the engine of $FPC_{DELV}$ to control the delivery of the fuel;

subsequent to said tests, operating engines of said family with sensors provided to obtain signals indicating respectively engine load, engine speed, charge air temperature ($T_{CH}$), ambient pressure ($P_{AT}$), and exhaust pressure ($P_{EX}$);

calculating from sensor signals $T_{CH}$, $P_{AT}$, $P_{EX}$, and using values from look-up maps of $K_1$, $K_2$, and $T_{CM}$ based on engine load and engine speed, a value for $IACC_{WOT}$ in accordance with the algorithm $$IACC_{WOT} = \frac{K_1 \times D_{CM} \times P_{AT}\,[1 - K_2\,(P_{EX})][P_{AT}]}{T_{CM} + T_{CH}}$$

wherein $IACC_{WOT}$ is induced air mass per cylinder per cycle at wide open throttle and $D_{CM}$ is a calibration coefficient previously determined experimentally;

looking up a value of $K_{LD}$ based upon load and speed, and calculating a value of $IACC_{LD}$ for existing engine operating conditions according to $IACC_{L-D}=IACC_{WOT}$ X $K_{LD}$; and controlling fuel supply to the engine based upon said calculated $IACC_{LD}$.

2. A management method of internal combustion engines of a specific family including determining mass of air induced per cycle (IACC) of the engine under normal operating conditions comprising steps of:

prior to operation under normal operating conditions, operating a selected engine of said family at both ambient conditions and at elevated charge air temperatures ($T_{CH}$) while keeping all other conditions equal, over a series of speed and load conditions, and taking measurements to create look-up maps from which coefficients relating to charge temperature ($T_{CM}$) and selected load demand coefficient ($K_{LD}$) may be looked up for any combination of engine speed and load, and further operating and measuring conditions of said representative model of the engine both at wide open throttle (WOT) and over a range of engine speeds at ambient conditions and at induced exhaust back pressures and, using these measurements and the previously created look-up maps to create look-up maps of cylinder displacement constant ($K_1$) and exhaust pressure coefficient ($K_2$) over said speed range;

then, operating engines of said family under normal operating conditions while taking measurements of load, engine speed, charge air temperature ($T_{CH}$), ambient pressure ($P_{AT}$) and exhaust pressure ($P_{EX}$), respectively, and employing those measurements and said look-up maps to create look-up maps of $K_1$, $K_2$, and ($T_{CM}$) to calculate IACC at wide open throttle ($IACC_{WOT}$) for the existing engine speed and operating conditions;

selecting an appropriate coefficient $K_{LD}$ based upon existing load and speed and applying said coefficient to the calculated $IACC_{WOT}$ to determine current reduced air mass $IACC_{LD}$;

using a signal of said determined $IACC_{LD}$ to control the rate of fuel supply per cylinder per cycle of the engine;

inputting signals to memory of the ECU lookup maps of respective coefficients relating to $P_{AT}$, $P_{EX}$ and $T_{CH}$ for selected engine speeds within said range of engine speeds corresponding to an operating speed range of an operational engine;

inputting signals to said memory of the ECU look up maps of coefficients relating $IACC_{WOT}$ to IACC at selected load demands below WOT at each said selected speed;

providing input signals to the ECU of $T_{CH}$, $P_{AT}$ and $P_{EX}$ from said sensors while operating engines of said family;

calculating $IACC_{WOT}$ from said input signals and said look up maps provided said ECU;

calculating based upon $IACC_{WOT}$, a value for fuel per cylinder per cycle to be delivered to the engine ($FPC_{DELV}$), and providing a signal from said ECU to the engine of $FPC_{DELV}$ to control the delivery of the fuel.

3. The method as set forth in claim 1 further including the steps of modulating a factor relating to at least on of $P_{AT}$, $P_{EX}$, and $T_{CH}$ to limit the influence of that factor in determining engine operating conditions.

4. The method as set forth in claim 1 wherein said step of calculating from $IACC_{WOT}$ a value for fuel per cylinder per cycle includes the step of:

determining an existing load and speed coefficient from a look-up map stored in the ECU memory and applying said coefficient to the calculated value of $IACC_{WOT}$ to determine current induced air mass $IACC_{LD}$;

determining from said $IACC_{LD}$ and sensed engine speed and load demand the required mass of fuel per cylinder per cycle ($FPC_{CALC}$); and determining a value of required fuel per cycle ($FPC_{CALIB}$) on sensed engine load and speed and determining, based upon $FPC_{CALIB}$ and $FPC_{CALC}$, said amount of fuel per cycle to be actually delivered ($FPC_{DELV}$).

5. The method as set forth in claim 2 further including the steps of modulating a factor relating to at least on of $P_{AT}$, $P_{EX}$, and $T_{CH}$ to limit the influence of that factor in determining engine operating conditions.

6. The method as set forth in claim 2 wherein said step of calculating from $IACC_{WOT}$ a value for fuel per cylinder per cycle includes the step of:

determining an existing load and speed coefficient from a look-up map stored in the ECU memory and applying said coefficient to the calculated value of $IACC_{WOT}$ to determine current induced air mass $IACC_{LD}$;

determining from said $IACC_{LD}$ and sensed engine speed and load demand the required mass of fuel per cylinder per cycle ($FPC_{CALC}$); and determining a value of required fuel per cycle ($FPC_{CALIB}$) on sensed engine load and speed and determining, based upon $FPC_{CALIB}$ and $FPC_{CALC}$, said amount of fuel per cycle to be actually delivered ($FPC_{DELV}$).

* * * * *